US005171931A

United States Patent [19]

Steele

[11] Patent Number: 5,171,931

[45] Date of Patent: Dec. 15, 1992

[54] PRESSURE RELIEF MEANS FOR JET-PROPELLED MISSILES

[75] Inventor: Michael F. Steele, Cincinnati, Ohio

[73] Assignee: Brunswick Corporation, Skokie, Ill.

[21] Appl. No.: 822,882

[22] Filed: Jan. 21, 1992

[51] Int. Cl.[5] ..... F41F 3/04

[52] U.S. Cl. ..... 89/1.808; 42/105; 60/223

[58] Field of Search ..... 89/1.808; 42/105, 1.06; 102/483, 381; 60/223, 254, 233, 242, 271

[56] References Cited

U.S. PATENT DOCUMENTS

| | | | |
|---|---|---|---|
| 2,587,933 | 3/1952 | Volpin | 137/70 |
| 2,850,976 | 9/1958 | Seifert | 60/254 |
| 2,939,275 | 6/1960 | Loedding | 60/39.1 |
| 2,958,184 | 11/1960 | Sanders | 60/223 |
| 2,958,185 | 11/1960 | Sanders | 60/223 |
| 3,171,248 | 3/1965 | Ledwith | 60/39.1 |
| 3,177,655 | 4/1965 | White | 60/254 |
| 3,200,584 | 8/1965 | Mitchell | 137/70 |
| 3,434,291 | 3/1969 | Friedman | 60/254 |
| 3,554,078 | 1/1971 | Horvath | 80/1.808 |
| 3,981,360 | 9/1976 | Marathe | 137/70 |
| 4,317,470 | 3/1982 | Taylor | 137/70 |
| 4,403,435 | 9/1983 | Baker et al. | 42/105 |
| 4,406,210 | 9/1983 | Baker et al. | 89/1.808 |
| 4,787,409 | 11/1988 | Taylor | 137/70 |

*Primary Examiner*—David H. Brown

*Attorney, Agent, or Firm*—Wood, Phillips, VanSanten, Hoffman & Ertel

[57] ABSTRACT

A system is disclosed for relieving excessive pressure within a combustion chamber of a spin-stabilized, jet-propelled missile launching system. An annular passage surrounds an exhaust nozzle, the passage being in communication with the chamber. A unitary valve ring closes the passage. Frangible pins hold the unitary valve ring in its closing position. An exhaust vent slaving cavity is provided for capturing the unitary valve ring upon rupture of the frangible pins. Exhaust vent ports communicate the slaving cavity with atmosphere, whereby the slaving cavity operates to capture the entire unitary valve ring bodily upon rupture of the frangible pins in response to excessive pressure within the chamber to relieve the pressure as the exhaust vent ports exhaust the chamber.

14 Claims, 2 Drawing Sheets

PRESSURE RELIEF MEANS FOR JET-PROPELLED MISSILES

FIELD OF THE INVENTION

This invention generally relates to the art of spin-stabilized jet-propelled missiles and, particularly, to a launching system for such missiles which includes means for relieving excessive pressure within a combustion chamber of a missile.

BACKGROUND OF THE INVENTION

In jet-propelled missiles, such as spin-stabilized spherical missiles, a solid propellent motor chamber forms a combustion chamber for the missile. The chamber is filled or nearly filled with a solid propellent material either combined with or in conjunction with an igniter substance. Upon ignition, the solid propellent burns very rapidly to produce considerable volumes of gas that is exhausted at high velocity through a restricted nozzle, thereby producing thrust for the missile. The size of the nozzle is relatively small in comparison to the size of the combustion chamber. With the volume of generated gas from combustion being quite large, high pressures often are built up in the combustion chamber which can approach the bursting strength of the propellent/motor casing These are very dangerous conditions and can cause a catastrophe, particularly in environments of spherical spin-stabilized missiles which are mounted on the ends of rifles operated in close proximity by an individual. The term "spherical" herein is being used in a generic sense to mean line-of-sight projectiles or missiles.

Consequently, it would be highly desirable to provide safety measures to prevent premature bursting of such missiles as a result of excessive pressure built up within the combustion chamber by rapidly relieving the pressure whenever the pressure becomes dangerously high.

Heretofore, various pressure responsive safety devices have been proposed for jet-propulsion motors, such as the devices disclosed in U.S. Pat. Nos. 2,958,184 and 2,958,185 to V. M. Sanders, both dated Nov. 1, 1960. The devices shown in these patents generally include a rupturable diaphragm fitted along with a nozzle in a housing and positioned in such a manner that the diaphragm ruptures to prevent a high pressure from bursting the combustion chamber. The gasses that escape through the ruptured diaphragm are ducted and released to the atmosphere perpendicular to the normal longitudinal axis of the motor.

One of the problems with prior rupturable safety devices, particularly devices of the rupturable diaphragm type described above, is that the ruptured diaphragms tend to cause the expulsion of fragments which, in certain environments, can be as dangerous to personnel as the actual bursting of the missile itself. In addition, particularly with spin-stabilized spherical missiles, transverse expulsion of the exhausted gasses can cause the missiles to break away from their receptacles and become out of control. Still further, the bursting of a diaphragm often is not symmetrical and again, this can be critical with a symmetrical, spherical spin-stabilized jet-propelled missile.

This invention is directed to solving the above problems by providing a novel means for relieving excessive pressure within the combustion chamber of a jet-propelled missile wherein the safety valve means is unitary and is captured bodily within the missile itself, along with symmetrical exhaustion of the excessive gasses.

SUMMARY OF THE INVENTION

An object, therefore, of the invention is to provide a new and improved means for relieving excessive pressure within a jet-propelled missile.

The invention is disclosed herein as adapted for use in a spin-stabilized, jet-propelled missile launching system which includes a generally spherical missile having a propellent/motor chamber. An exhaust nozzle means leads from the chamber. Annular passage means surround the exhaust nozzle means in communication with the chamber. Unitary valve means close the passage means. Frangible means hold the unitary valve means in its closed position. An exhaust vent slaving cavity is provided for capturing the unitary valve means upon rupture of the frangible means. Exhaust vent means communicate the slaving cavity with atmosphere. Therefore, the slaving cavity operates to capture the entire unitary valve means upon rupture of the frangible means in response to excessive pressure within the cavity to relieve the pressure as the vent means exhausts the chamber.

As disclosed herein, the frangible means are provided in the form a plurality of shear pins substantially equally spaced angularly about the exhaust nozzle means. The unitary valve means is part of a valve assembly wherein the valve means is generally rigid, and including resilient seal means between the valve means and the annular passage means. The exhaust nozzle means define an exhaust axis and the slaving cavity is annular, located axially of the passage means and concentric with the axis. The exhaust vent means are provided in the form of a plurality of radially extending ports substantially equally spaced angularly about the axis.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
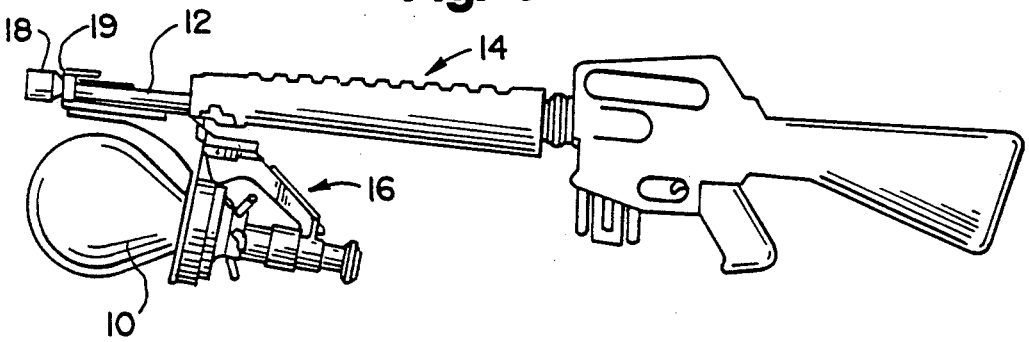
FIG. 1 is an elevational view of a spin-stabilized missile mounted on the barrel of a rifle.

Referring to the drawings in greater detail, and first to FIG. 1, a substantially spherical, spin-stabilized self-propelled missile 10 is shown mounted to the front of a barrel 12 of an assault weapon such as a rifle, generally designated 14. The rifle shown is a standard M-16A2 military rifle or any similar device. The deployment structure may be any fixed or portable structure, and the utility of the invention is not limited to a hand carried weapon such as a rifle.

As shown in FIG. 1, a missile support means, generally designated 16, include a front upper attachment portion 18 with axial motion restraint means 19. Attachment portion 18 is generally tubular for positioning over barrel 12. The attachment portion 18 is positioned on barrel 12 whereby part of the gas emanating from the barrel is channeled to a firing pin assembly which is effective to strike a primer on missile 10 to ignite the rocket propellant therein, as is known in the art.

Figure 2:
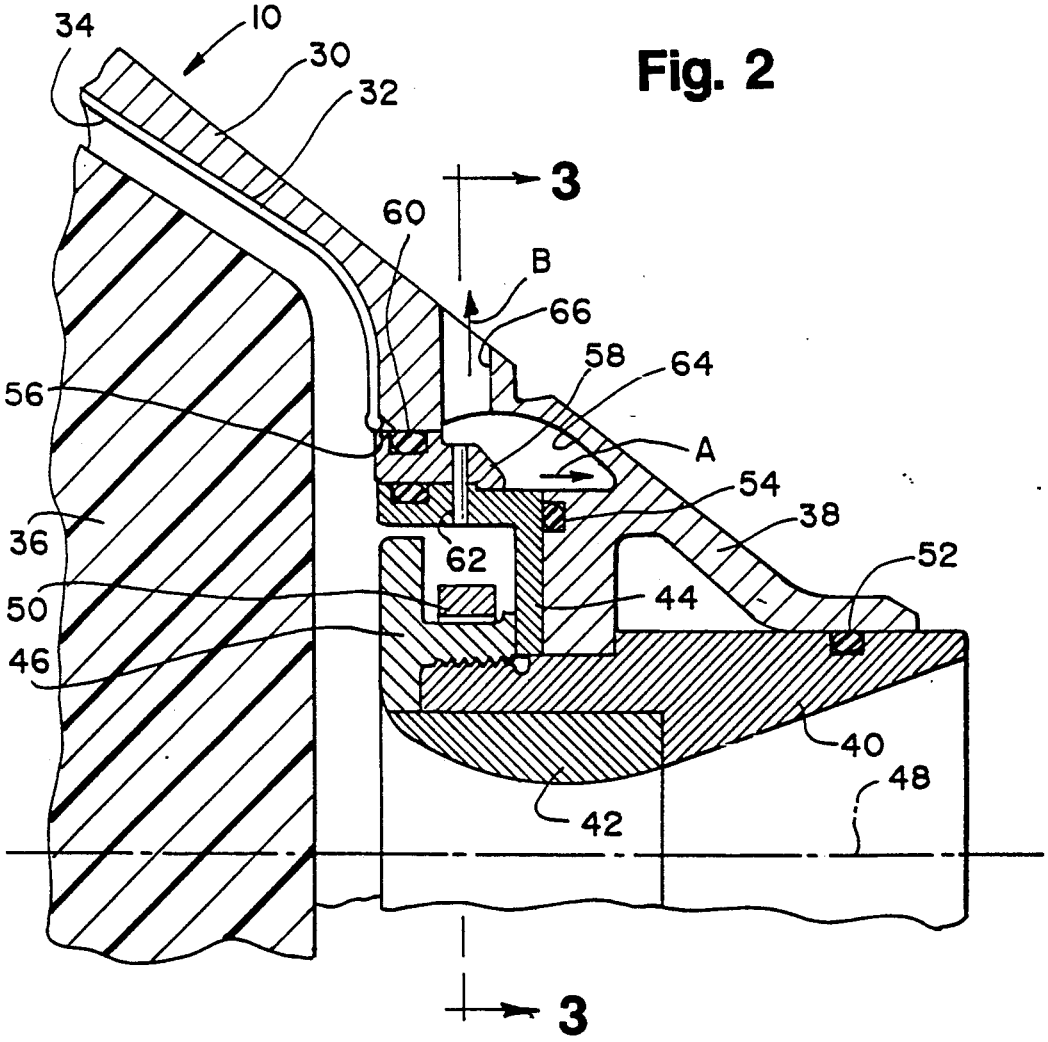
FIG. 2 is a fragmented axial section, on an enlarged scale, through the exhaust nozzle area of the missile and including the pressure relief means of the invention.
Figure 3:
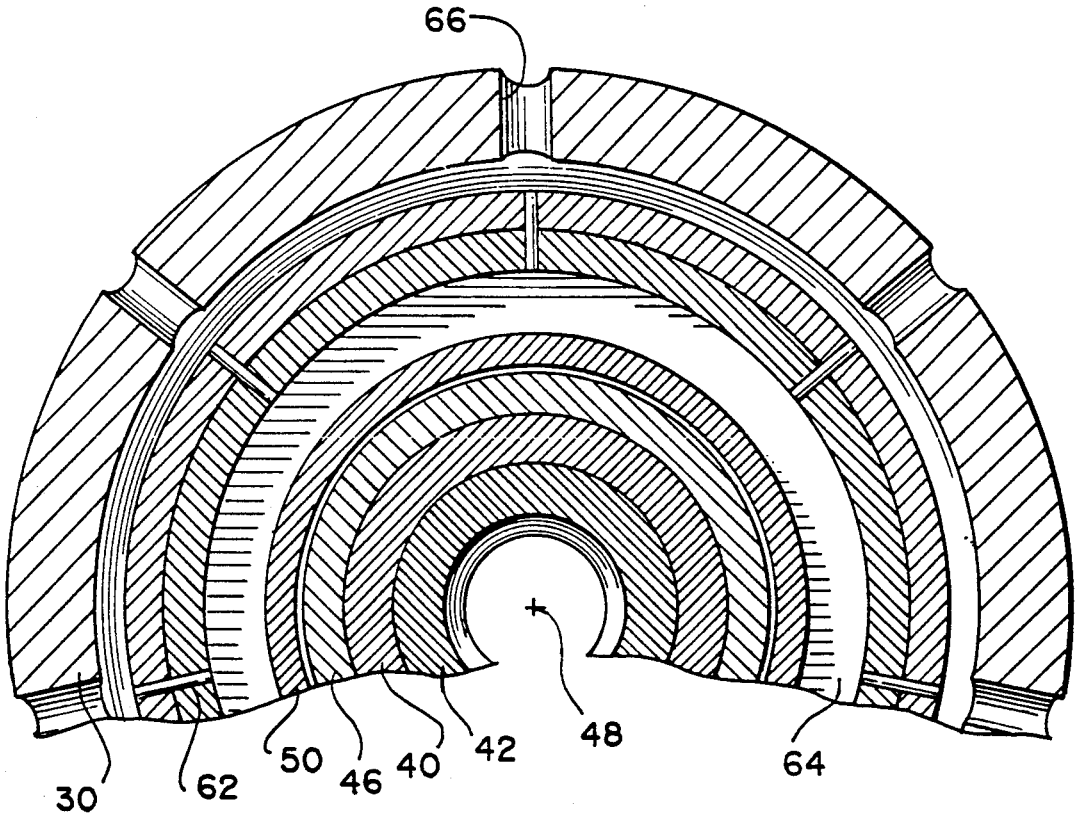
FIG. 3 is a vertical section taken along line 33 of FIG. 2.

Referring to FIG. 2, missile 10 includes a motor casing 30 having an insulator lining 32 and defining a propellent/motor combustion chamber 34. A solid propellent material 36 is disposed within chamber 34. The solid propellent may be combined with an igniter substance or, although not shown in the drawings, the right-hand portion of the propellent may comprise an igniter material. The casing terminates at its aft end in an annular nozzle portion 38.

A nozzle assembly is inserted within nozzle portion 38 of missile casing 30. More particularly, the nozzle assembly includes a nozzle body 40, a high temperature nozzle insert 42, an igniter housing 44 and an igniter closure 46. Nozzle portion 38 of missile casing 30, nozzle body 40 and nozzle insert 42 all are annular or ring-like in construction to define a nozzle or exhaust axis 48. Preferably, igniter housing 44 and igniter closure 46 also are annular in construction to contain an annular igniter charge 50 whereby, when ignited, the charge ignites the igniter and/or propellent material within motor casing 30 generally uniformly about axis 48. Whereas nozzle insert 42 may be inlaid or substantially integral with nozzle body 40, resilient seal rings 52 and 54 are provided between nozzle portion 38 and nozzle body 40 and igniter housing 44, respectively.

Generally, the invention contemplates a unitary means for relieving excessive pressure within combustion chamber 34 of missile casing 30, whereby the unitary means moves bodily to relieve high pressure within the combustion chamber, thereby avoiding bursting of the motor casing.

More particularly, an annular passage 56 is formed in communication with combustion chamber 34 about the nozzle assembly. In the disclosed embodiment, the annular passage is formed between motor casing 30 and igniter housing 44 concentric about axis 48. A unitary valve means, in the form of a rigid valve ring 58, is located in annular passage 56. The valve ring 58 is annular and concentric with axis 48 and nozzle components 38, 40 and 42 O-ring seals 60 are provided on opposite radial sides of unitary valve ring 58. The valve ring is held in position, in passage 56, by frangible means in the form of a plurality of shear pins 62. Although only one shear pin is visible in FIG. 2, it should be understood that at least four, but preferably more, shear pins are employed substantially equally spaced angularly about the exhaust nozzle means and axis 48. An exhaust vent slaving cavity 64 is formed in the motor casing and/or nozzle portion 38 axially and rearwardly of valve ring 58. The slaving cavity is elongated axially and is shaped and sized to capture valve ring 58 upon rupture of shear pins 62. In other words, the invention contemplates that valve ring 58 does not rupture, as with a rupturable diaphragm, but the rupturing of shear pins 62 allow the valve ring to move bodily in the direction of arrow "A" into slaving cavity 64 whereat the valve ring remains during and after relief of excessive pressure from combustion chamber 34 through annular passage 56.

Exhaust vent means also are provided in communication with slaving cavity 64 to exhaust the escaping gasses from combustion chamber 34, through annular passage 56, to atmosphere. More particularly, a plurality of radially extending exhaust ports 66 are formed in motor casing 30 and/or nozzle portion 38 communicating slaving cavity 64 to atmosphere, in the direction of arrow "B". Again, like shear pin is 62, although only one exhaust port 66 is visible in FIG. 2, at least four, but preferably more, exhaust ports are provided substantially equally spaced angularly about the exhaust nozzle assembly and axis 48.

The particular pressure at which combustion chamber 34 is to be relieved is calculated by the shear capabilities of shear pins 62 in relation to the bursting capabilities of motor casing 30. Of course, the restrictive capabilities of the restricted orifice at nozzle insert 42 is taken into consideration. Appropriate calculations are used to design shear pins 62 so that the pins shear before the motor casing bursts.

In operation, once the pressure builds excessively within combustion chamber 34, as calculated by the shear capabilities of pins 62, the pins will shear and the excessive pressure will drive unitary valve ring 58 bodily in the direction of arrow "A" into slaving cavity 64. The slaving cavity captures the valve ring and allows the excessive pressurized gas to escape through exhaust ports 66 in the direction of arrow "B" to atmosphere. Because the pins shear, versus rupture, and because valve ring 58 is bodily captured within slaving cavity 64, there are no fragments to escape dangerously to atmosphere. The exhaust gasses are directed radially away from an aft positioned operator. The entire assembly, including the shear pins, the unitary valve ring, the exhaust ports and the annular slaving cavity provide total symmetry for the various forces involved in releasing the excessive pressure within the symmetrical spherical missile.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a spin-stabilized, jet-propelled missile launching system which includes a generally spherical missile having a propellant/motor combustion chamber and an exhaust nozzle means leading from the chamber, means for relieving excessive pressure within the chamber comprising annular passage means surrounding the exhaust nozzle means in communication with the chamber, unitary valve means closing the passage means, frangible means for holding the unitary valve means in a closing position, an exhaust vent slaving cavity for capturing the unitary valve means upon rupture of the frangible means, and exhaust vent means communicating the slaving cavity with atmosphere, whereby the slaving cavity operates to capture the entire unitary valve means bodily upon rupture of the frangible means in response to excessive pressure within the chamber to relieve the pressure as the vent means exhausts the chamber.

2. In a spin-stabilized, jet propelled missile launching system as set forth in claim 1, wherein said frangible means comprise a plurality shear pins substantially equally spaced angularly about the exhaust nozzle means.

3. In a spin-stabilized, jet-propelled missile launching system as set forth in claim 1, wherein said unitary valve means comprise part of a valve assembly wherein the valve means is generally rigid and including resilient seal means between the valve means and the annular passage means.

4. In a spin-stabilized, jet-propelled missile launching system as set forth in claim 1, wherein said exhaust nozzle means define an exhaust axis, and said salving cavity is located axially of the passage means.

5. In a spin-stabilized, jet-propelled missile launching system as set forth in claim 4, wherein said slaving cavity is annular and concentric with the annular passage means and said axis.

6. In a spin-stabilized, jet-propelled missile launching system as set forth in claim 4, wherein said exhaust vent means comprise a plurality of radially extending ports.

7. In a spin-stabilized, jet-propelled missile launching system as set forth in claim 6, wherein said ports are substantially equally spaced angularly about said axis.

8. In a spin-stabilized, jet-propelled missile launching system which includes a generally spherical missile having a propellent/motor combustion chamber and an exhaust nozzle means leading from the chamber and defining an exhaust axis, means for relieving excessive pressure within the chamber comprising annular passage means surrounding the nozzle means in communication with the chamber and concentric with said axis, a unitary valve ring closing the annular passage means, a plurality of shear pins for holding the unitary valve ring in a closing position, the shear pins being substantially equally spaced angularly about said axis, an exhaust vent slaving cavity located axially of the passage means for capturing the unitary valve ring upon rupture of the shear pins, the slaving cavity being annular and concentric with the annular passage means and said axis, and exhaust vent means in the form of a plurality of radially extending ports communicating the slaving cavity to at atmosphere, the ports being substantially equally spaced angularly about said axis, whereby the slaving cavity operates to capture the entire unitary valve ring bodily upon rupture of the shear pins in response to excessive pressure within the cavity to relieve the pressure as the ports exhaust the chamber.

9. In a spin-stabilized, jet-propelled missile launching system as set forth in claim 8, wherein said unitary valve ring comprises part of a valve assembly wherein the valve ring is generally rigid and including resilient seal means between the valve ring and the annular passage means.

10. In a jet-propelled missile launching system which includes a missile having a propellent/motor combustion chamber and an exhaust nozzle means leading from the chamber, means for relieving excessive pressure within the chamber comprising passage means surrounding the exhaust nozzle means in communication with the chamber, unitary valve means closing the passage means, frangible means for holding the unitary valve means in a closing position, an exhaust vent slaving cavity for capturing the unitary valve means upon rupture of the frangible means, an exhaust vent means communicating the slaving cavity with atmosphere, whereby the slaving cavity operates to capture the entire unitary valve means bodily upon rupture of the frangible means in response to excessive pressure within the cavity to relieve the pressure as the vent means exhausts the chamber.

11. In a jet-propelled missile launching system as set forth in claim 10 wherein said frangible means comprises a shear pin.

12. In a jet-propelled missile launching system as set forth in claim 10, wherein said unitary valve means comprise part of a valve assembly wherein the valve means is generally rigid and including resilient seal means between the valve means and the passage means.

13. In a jet-propelled missile launching system as set forth in claim 10, wherein said exhaust nozzle means define an exhaust axis, and said salving cavity is located axially of the passage means.

14. In a jet-propelled missile launching system as set forth in claim 10, wherein said exhaust vent means extend radially of the exhaust nozzle means.

* * * * *